US006412595B1

(12) United States Patent
Horak et al.

(10) Patent No.: US 6,412,595 B1
(45) Date of Patent: Jul. 2, 2002

(54) ECONOMICAL EXHAUST MUFFLER SYSTEM FOR A MARINE PROPULSION APPARATUS

(75) Inventors: James M. Horak, Stillwater; Brian D. Simpson, Yale, both of OK (US)

(73) Assignee: Brunswick Corporation, Lake Forest, IL (US)

( * ) Notice: Subject to any disclaimer, the term of this patent is extended or adjusted under 35 U.S.C. 154(b) by 106 days.

(21) Appl. No.: 09/625,939

(22) Filed: Jul. 26, 2000

(51) Int. Cl.[7] ..... F01N 3/00
(52) U.S. Cl. ..... 181/221; 181/223; 181/235
(58) Field of Search ..... 181/233, 235, 181/260, 262, 263, 221

(56) References Cited

U.S. PATENT DOCUMENTS 4,019,456 A 4/1977 Harbert ..... 115/73
4,100,994 A * 7/1978 Stuart ..... 181/261
4,887,692 A * 12/1989 Outani et al. ..... 181/176
5,550,337 A * 8/1996 Tazaki et al. ..... 181/235
5,554,058 A * 9/1996 LeQuire ..... 181/260
5,594,217 A 1/1997 LeQuire ..... 181/235
5,746,630 A * 5/1998 Ford et al. ..... 181/260
6,024,617 A * 2/2000 Smullin et al. ..... 181/260

* cited by examiner

*Primary Examiner*—Robert E. Nappi
*Assistant Examiner*—Kim Lockett
(74) *Attorney, Agent, or Firm*—William D. Lanyi

(57) ABSTRACT

A muffler is provided for a marine propulsion system in which an initial portion causes a downward flow of exhaust gas and entrained water from an exhaust manifold. The transition section directs the exhaust gas toward an egress section which extends upwardly from the transition section. The various sections of the exhaust path can be configured to form one or more loops which define one or more water collection regions.

12 Claims, 4 Drawing Sheets

ECONOMICAL EXHAUST MUFFLER SYSTEM FOR A MARINE PROPULSION APPARATUS

BACKGROUND OF THE INVENTION

1. Field of the Invention

The present invention is generally related to a muffler system for a marine propulsion apparatus and, more particularly, to an exhaust system that comprises a conduit that is shaped to form a water collection region, or water trap, and which can be configured in a single loop or multiple loop arrangement.

2. Description of the Prior Art

As is well known to those skilled in the art of marine propulsion systems, particularly sterndrive or inboard systems, cooling water is commonly injected into an exhaust gas stream and the combined exhaust gas and entrained water mixture is conducted through common conduits within the exhaust system. It is also well known to those skilled in the art that certain types of mufflers, sometimes referred to as "water lift" mufflers, can provide an expansion chamber in which water can be collected and in which the collected water reduces the overall noise emitted by the internal combustion engine and its associated exhaust system. Known types of water lift mufflers have several negative characteristics. First, the expansion chamber of known water lift mufflers requires significant space in the region behind the internal combustion engine of a marine propulsion system. In addition, these mufflers can significantly increase the overall cost of the exhaust system. Furthermore, these mufflers are prone to a problem that is commonly referred to as "water ingestion" because of the arrangement of conduits and components that are common in applications using water lift mufflers.

U.S. Pat. No. 4,019,456, which issued to Harbert on Apr. 26, 1977, describes a marine wet exhaust system and improvements in powered marine vessels. The system comprises an exhaust gas cooling water separation chamber, a gas collection chamber, and gas acceleration and gas flow-shaping conduit means. The entrance of the separation chamber is connectable to water coolant and gas exhaust tubes from a marine engine. The separation chamber is fitted with a water deflector disposed below the gas exit from that chamber, while a gas dam is disposed in the water exit from that chamber, the entrance and water exit going below the deflector level. The gas collection chamber is connected to the gas exit and a gas acceleration chamber, which tapers downstream, is connected to the gas collection chamber. A gas velocity tube is connected to and extends downstream of the gas acceleration chamber to cause exhaust gases to exit through the hull of a boat in which the system may be installed with sufficient force to penetrate the turbulent boundary layer of air around the boat hull when the boat is in motion, thus preventing the gases from passing back into the rear of the boat, due to the "station wagon" effect. An air dilution tube can be connected to the gas velocity tube to provide a scarfing action by the exhaust gases, causing their dilution to below noxious levels. The system may include exhaust noise retarding means, such as a muffler and/or air barrier at the separation chamber entrance.

U.S. Pat. No. 5,746,630, which issued to Ford et al on May 5, 1998, describes a combination wet marine exhaust muffler and water separator. The combined wet marine exhaust muffler and water separator comprises a housing having a tangential inlet for inducing the exhaust flow to rotate about a lengthwise axis of the housing, a first outlet positioned along the axis for conducting dried exhaust gas from the housing, and a second outlet positioned near a bottom end of the housing and spaced from the tangential inlet and the first outlet for draining water from the housing.

U.S. Pat. No. 5,594,217, which issued to LeQuire on Jan. 14, 1997, describes an exhaust muffler for small marine craft. The muffler can be located in the rear portion of the bilge and straddle the drive shaft and the shaft log. The muffler has a shell formed from sides, ends, top and bottom walls. The bottom wall is provided with a concave depression to receive the shaft and shaft log. A preferred configuration of the depression is a semi-conical surface having a base proximate the inlet wall. Further, the top and bottom walls are configured to conform to the undersurface of the deck and the inside of the hull respectively. An inlet pipe, or a multiple number of inlet pipes, receive exhaust gases and water from the exhaust manifold of the craft engine and direct this combination into the muffler above a water pool. Gases pass through the water pool and exit through an outlet pipe or a plurality of outlet pipes. A downwardly extending conduit within the outlet pipes provides a correct amount of lift such that an amount of water exits the muffler which is the same as the amount entering. Because of the shape and construction, the muffler can be placed within the bilge of the craft in a space that is normally not used.

U.S. patent application Ser. No. 09/604,147 (M09434) which was filed by Erickson on Jun. 27, 2000 and titled "Exhaust Elbow With a Water Trap for a Marine Propulsion System" describes an exhaust elbow for a marine propulsion exhaust system which is provided with a water trap section that defines a water collection cavity. Within the water trap section, a barrier extends downward into the water collection cavity to define first and second exhaust passages. When water begins to collect in the water collection cavity, the cross sectional area of the exhaust passage is reduced and the velocity of exhaust gases passing through the exhaust passage is increased. The water collection cavity is shaped to be easily cleared when exhaust gas pressure increases as the engine speed increases.

The patents described above are hereby expressly incorporated by reference in the description of the present invention.

It would be significantly beneficial if a muffler could be provided for a marine propulsion system in which the components of the muffler were relatively inexpensive, but would provide the noise reducing benefits of a water lift muffler. It would be particularly beneficial if a muffler of this type could be provided in which the basic components required to construct the muffler were relatively inexpensive and readily available.

SUMMARY OF THE INVENTION

A muffler for an exhaust system of a marine propulsion device made in accordance with the present invention comprises an ingress conduit which is attachable in fluid communication with an exhaust manifold of an internal combustion engine. The muffler, itself, does not require the presence of the exhaust manifold, but is designed to be associated with an exhaust manifold of an engine. The muffler further comprises a water collection cavity that is connected in fluid communication with the ingress conduit. A muffler made in accordance with the preferred embodiment of the present invention further comprises an egress conduit connected in fluid communication with the water collection cavity, whereby water entrained in an exhaust stream from the engine is induced to accumulate within the water collection cavity, within a lowest region of the ingress conduit, and within a lowest region of the egress conduit in response to the exhaust stream flowing sequentially from the exhaust manifold, through the ingress conduit, the water collection cavity, and the egress conduit. The ingress and egress conduits are connected in fluid communication with each other only indirectly through the water collection cavity. The water collection cavity defines a confined fluid path between the ingress conduit and the egress conduit.

In a particularly preferred embodiment of the present invention, the water collection cavity is a generally tubular passage between the ingress and egress conduits. The exhaust stream flows sequentially downward through the effective length of the ingress conduit, generally horizontally through the effective length of the water collection cavity, and upward through the effective length of the egress conduit.

The present invention, in certain embodiments, can further comprise a generally horizontal intermediate conduit connected in fluid communication with the egress conduit, with the egress conduit being connected in fluid communication between the water collection cavity and the generally horizontal intermediate conduit. The muffler can further comprise a final exhaust conduit connected in fluid communication with, and extending downward from, the generally horizontal intermediate conduit.

When used in a marine vessel, the muffler of the present invention further comprises an internal combustion engine and an exhaust manifold attached to the engine for directing the exhaust stream from a plurality of cylinders of the internal combustion engine to the ingress conduit. The exhaust manifold is normally connected in fluid communication with the ingress conduit.

An exhaust muffler made in accordance with the present invention comprises a first conduit loop which is attachable in fluid communication with an exhaust manifold of an internal combustion engine. The first conduit loop sequentially extends downward through a first section of the first conduit loop from the exhaust manifold and then upward through a second section of the first conduit loop. A central portion of the first conduit loop defines a first water collection region between the first and second sections of the first conduit loop, whereby an exhaust stream flows sequentially from the exhaust manifold, downward through the first section of the first conduit loop, through the water collection region, and then upward through a second section of the first conduit loop.

Certain embodiments of the present invention can further comprise a second conduit loop which is attachable in fluid communication with the first conduit loop, the second conduit loop sequentially extending downward through a third section of the second conduit loop from the first conduit loop and then upward through a fourth section of the second conduit loop. A second central portion of the second conduit loop defines a second water collection region between the first and fourth sections of the first and second conduit loops, whereby an exhaust stream flows sequentially from the exhaust manifold, downward through the first section of the first conduit loop, through the first water collection region, upward through the second section of the first conduit loop, through the third section of the second conduit loop, through the second water collection region, and finally through the fourth section of the second conduit loop.

A muffler system for a marine propulsion system made in accordance with a particularly preferred embodiment of the present invention comprises a channel for conducting a fluid mixture of exhaust gas and water from an exhaust manifold from an engine. The channel has an inlet, an outlet, and a first transitional section connecting the inlet and the outlet. The first transitional section is positioned below the inlet and the outlet by a sufficient distance to form a first liquid collection region through which the exhaust gas must pass as it flows from the inlet to the outlet. Although the present invention will be described below as a generally U-shaped channel configuration, it should be understood that a V-shaped configuration could also provide the inlet, the outlet, and a first transitional section positioned below the inlet and outlet by a sufficient distance to form a first liquid collection region through which the exhaust gas must pass as it flows from the inlet to the outlet.

The muffler system can further comprise a second transitional section connecting the inlet and the outlet. The second transitional section is positioned below the inlet and the outlet by a sufficient distance to form a second liquid collection region through which the exhaust gas must pass as it flows from the inlet to the outlet. The first and second transitional sections are connected in serial fluid communication with each other to direct the exhaust gas sequentially from the inlet, through the first liquid collection region, through the second liquid collection region, and through the outlet.

Particularly preferred embodiments of the present invention, when used within a marine vessel, further comprise the exhaust manifold of the engine which is connected in fluid communication with the inlet and an internal combustion engine that is connected, through the exhaust manifold, in fluid communication with the inlet.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
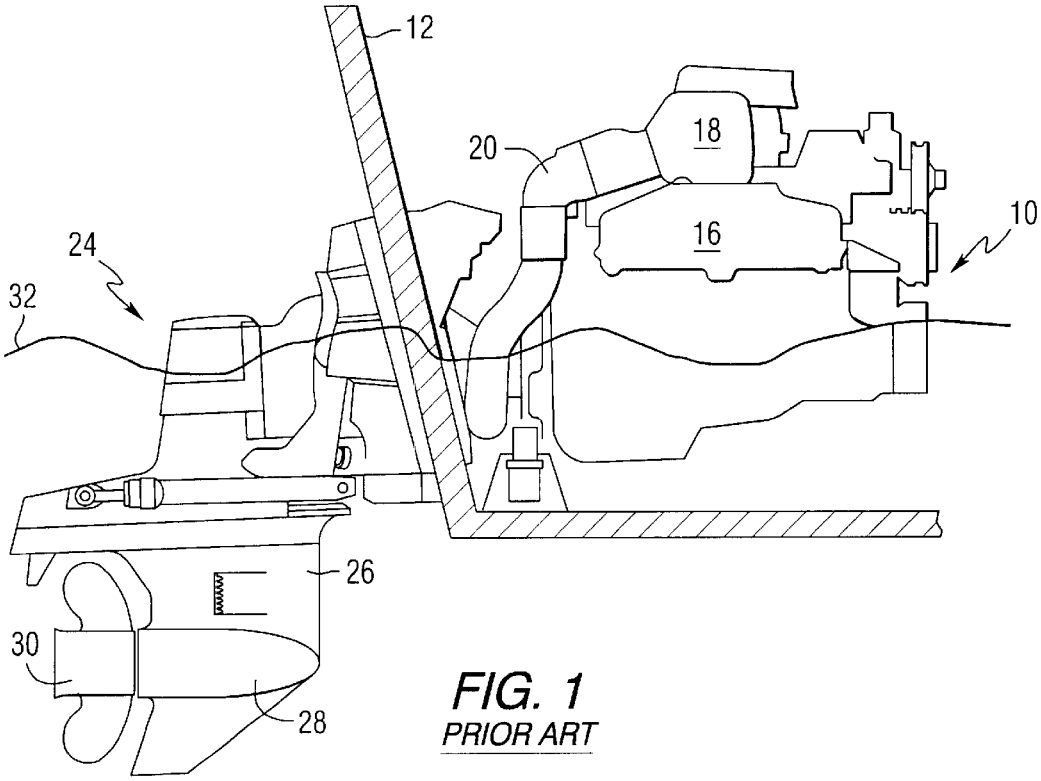
FIG. 1 PRIOR ART
FIG. 1 shows a known type of marine propulsion system.

Throughout the description of the preferred embodiment of the present invention, like components will be identified by like reference numerals.

FIG. 1 shows a side view of one particular type of marine propulsion system which is commonly referred to as a "sterndrive" system. It comprises an engine 10 which is located within a marine vessel forward of a transom 12. The internal combustion engine 10 is provided with an exhaust manifold 16 which directs exhaust gases from the cylinders of the engine 10 upward toward an exhaust elbow 18. The exhaust elbow 18 directs the exhaust stream rearwardly through exhaust conduits 20 that conduct the mixture of exhaust gases and cooling water through the transom 12 and through an outdrive downward through a driveshaft housing 26, propeller housing 28 and through the hub 30 of a propeller. In certain applications of marine propulsion systems, exhaust gases are also conducted through an opening in the transom 12 above the water line which is identified in FIG. 1 by reference numeral 32.

In certain types of marine propulsion systems, exhaust mufflers are provided for the purpose of silencing the sound emanating from the engine 10 and, more particularly, from the exhaust system which comprises the exhaust manifold 16, the exhaust elbow 18, and the conduits 20 that direct the exhaust stream away from the engine 10.

Figure 2:
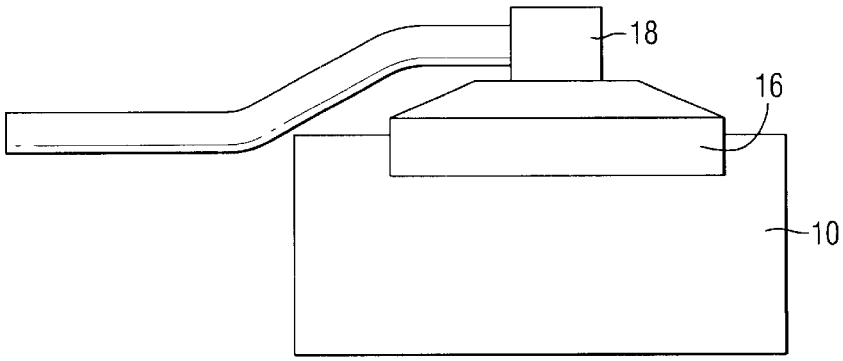
FIG. 2 PRIOR ART
FIG. 2 is a simplified representation of certain components shown in FIG. 1.

Various embodiments of the present invention will be described below in conjunction with highly simplified representations of the various components of the exhaust system. FIG. 2 is a simplified representation of the engine 10, the exhaust manifold 16, the exhaust elbow 18, and the exhaust conduits 20 described above in conjunction with FIG. 1.

Figure 3:
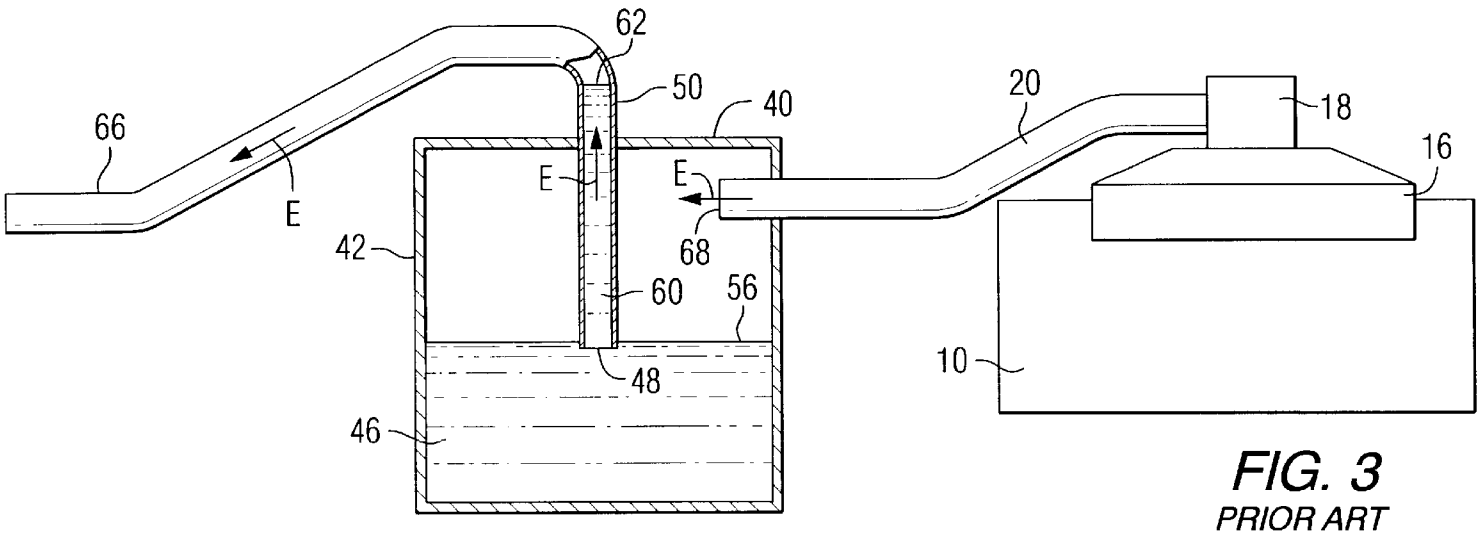
FIG. 3 PRIOR ART
FIG. 3 shows a known type of water lift muffler.

FIG. 3 shows a known type of muffler that can be used in conjunction with marine propulsion systems. The muffler shown in FIG. 3 is commonly referred to as a 'water lift" muffler. The exhaust gases and entrained cooling water pass through the exhaust conduit 20 and into a primary containment 40. The exhaust gases collect within the ullage 42 of the containment 40 and the cooling water collects in the lower portion of the containment 40. When sufficient water 46 collects in the containment 40 to cover the lower end 48 of the standpipe 50, the pressure in the ullage 42 caused by the exhaust gases passing from the exhaust conduit, as represented by arrow E, create pressure above the water level 56 within the containment 40. This pressure above the surface 56 of the water 46 causes a column of water 60 to rise within the standpipe 50 to the level represented by reference numeral 62. As a result of the increasing pressure of exhaust gases with the ullage 42, the water level 56 is forced downward to a point that allows exhaust gases to pass through the lower end 48 of the standpipe 50 and proceed upward through the standpipe 50 and subsequently through the exhaust conduits identified by reference numeral 66. This passage is represented by arrows E. The flow of the exhaust through the water 46 and 60 in this manner provides a certain degree of silencing of the noise would otherwise emanate from the exhaust conduits 20.

With continued reference to FIG. 3, it should be noted that the passage of exhaust gases and entrained cooling water emanating from the exhaust conduits 20 is not a confined fluid path that requires that the exhaust stream pass directly from the exhaust conduits 20 to the standpipe 50 and outward through the exhaust conduits 66. Instead, the exhaust gases can remain in the ullage 42 of the containment 40 for extended periods of time without passing upward through the lower end 48 of the standpipe 50 and out through the exhaust conduits 66. This can occur because the flow from the end 68 of the exhaust conduits 20 to the lower end 48 of the standpipe is not confined. Instead, the exhaust gases are free to flow in an unconfined manner through the ullage 42. The exhaust gases in the ullage 42 will eventually flow upward through the standpipe 50, but this flow is neither confined nor restricted to a sequential flow from end 68 of exhaust conduits 20 to the lower end 48 of the standpipe 50.

Figure 4:
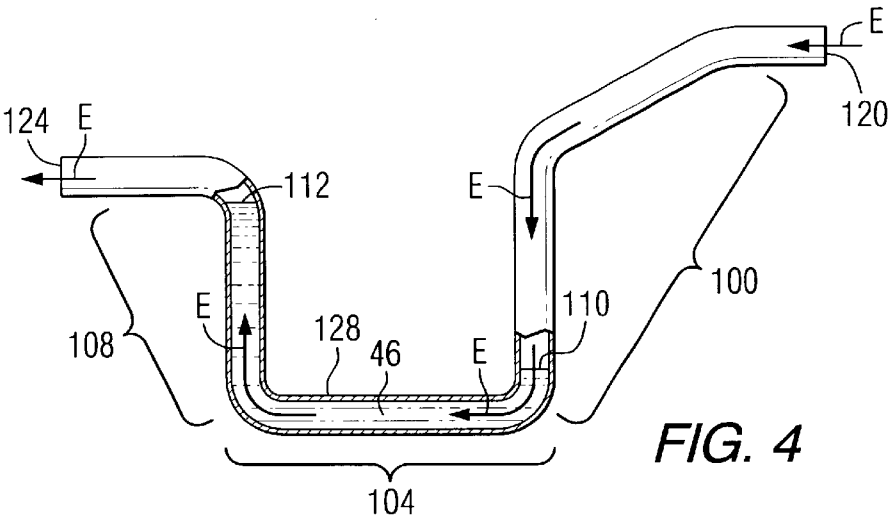
FIG. 4 shows a simplified embodiment of the present invention.

With reference to FIG. 4, the present invention provides an ingress conduit 100 which is attachable in fluid communication with an exhaust manifold 16, such as that described above in conjunction with FIGS. 1, 2, and 3, typically in combination with an exhaust elbow 18. The present invention comprises a water collection cavity 104 that is connected in fluid communication with the ingress conduit 100. An egress conduit 108 is connected in fluid communication with the water collection cavity 104. Water which is entrained in an exhaust system from the engine is induced to accumulate within the water collection cavity 104, in the is lowest region of the ingress conduit 100, and in the lowest region of the egress conduit 108 in response to the exhaust stream flowing sequentially through the ingress conduit 100, the water collection cavity 104, and the egress conduit 108. The ingress and egress conduits are connected in fluid communication with each other only indirectly through the water collection cavity 104 and the water collection cavity 104 defines a confined fluid path between the ingress conduit 100 and the egress conduit 108. In other words, exhaust gases are forced to flow along the confined and restricted path as represented by arrows E in FIG. 4. They are not free to linger within any portions of the muffler system. When the pressure of the exhaust gas is sufficient to lower water level 110 to the region where the water collection cavity 104 is opened sufficiently to allow the exhaust gases to pass through it, the water level 112 is correspondingly raised. It should be understood that, when in operation, the water levels represented by dashed lines 110 and 112 are highly turbulent and the water 46 trapped within the water collection cavity 104 is a bubbling froth of water and exhaust gases as the exhaust gases pass violently through the collected water 46. However, it is important to note that the path of exhaust gases, represented by arrows E, is strictly confined to the path shown in FIG. 4 and is forced to sequentially flow through ingress conduit 100, the water collection cavity 104, and the egress conduit 108, in that order.

With continued reference to FIG. 4, the various conduits are generally tubular passages in a preferred embodiment of the present invention and can comprise a combination of straight sections and elbow sections which are readily available commercially. In FIG. 4, the exhaust system muffler is represented in a generally U-shaped configuration. However, it should be understood that the ingress and egress conduits, 100 and 108, could alternatively be configured in a V-shaped arrangement, with the water collection cavity 104 being the lowest point of the V-shaped arrangement.

With continued reference to FIG. 4, the muffler system of the present invention comprises a channel for conducting a fluid mixture of exhaust gas and water from an exhaust manifold 16 of an engine 10. The channel has an inlet 120 and an outlet 124 and a transitional section 128 connecting the inlet 120 and the outlet 124 together. This transitional section 128 is positioned below the inlet 120 and the outlet 124 by a sufficient distance to form a first liquid collection region which is described above as the water collection cavity 104. Exhaust gas, represented by arrows E, must pass through the liquid collection region 128 as it flows from the inlet 120 to the outlet 124.

Figure 5:
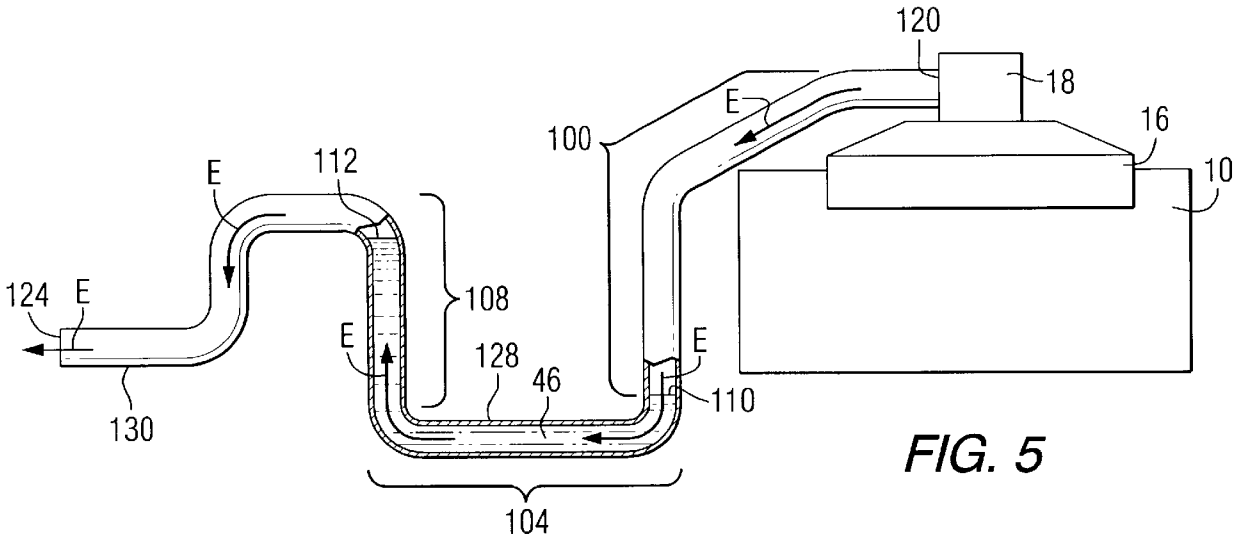
FIG. 5 shows another embodiment of the present invention.

FIG. 5 shows an embodiment of the present invention that is similar to that described above in conjunction with FIG. 4, but with an additional exhaust conduit 130 positioned between the inlet 120 and the outlet 124. Because of its location relative to the water collection cavity 104, the exhaust conduit 130 can be raised or lowered relative to the water collection cavity 104 and relative to the exhaust manifold 16 without causing any adverse effects. The operation of the muffler shown in FIG. 5 is essentially identical to the operation of the muffler described above in conjunction with FIG. 4, but with the outlet 124 lowered to suit a particular application.

Figure 6:
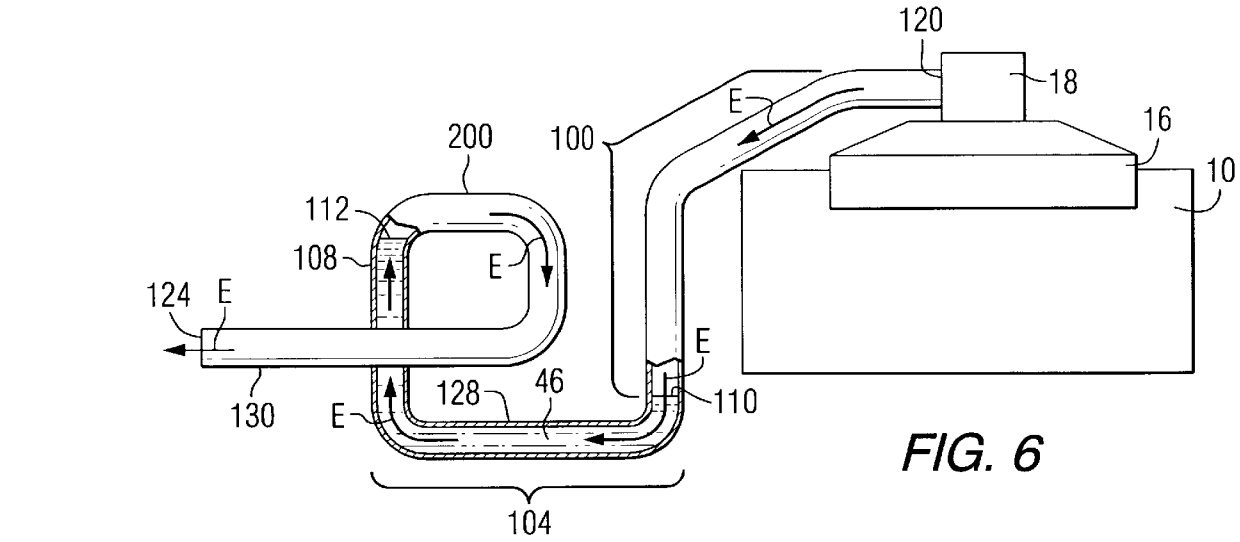
FIG. 6 shows a variation of the embodiment of the present invention shown in FIG. 5.

The embodiment of the present invention shown in FIG. 6 is generally similar to the embodiment of FIG. 5, but with the conduits being arranged in the configuration of a loop. A generally horizontal intermediate conduit 200 is connected to the egress conduit 108 in order to direct the exhaust flow back toward the engine 10 and then downward through the exhaust conduit 130 to the outlet 124. The overall effect on the exhaust stream of the configuration shown in FIG. 6 is generally similar to that shown in FIG. 5, but with the added advantage that it allows additional loops to be confined with the configuration shown in FIG. 6 without requiring excessive space in a marine vessel.

Figure 7:
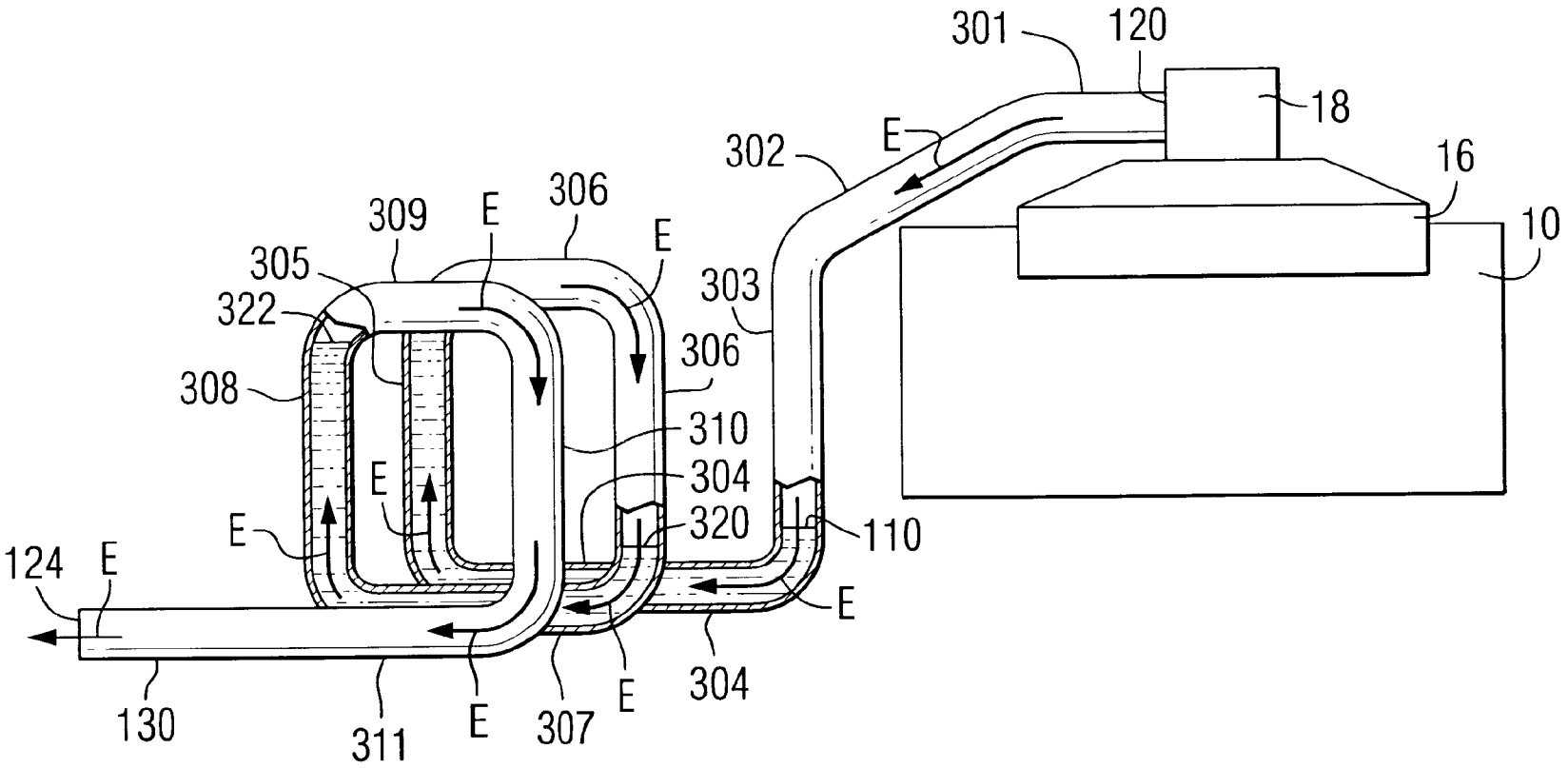
FIG. 7 shows an embodiment of the present invention which comprises two complete exhaust conduit loops.

FIG. 7 shows an embodiment of the present invention in which two conduit loops are used. To more clearly describe the operation of the embodiment of the present invention shown in FIG. 7, each individual segment of conduit will be identified by a distinct reference numeral. These distinct segments will then be described with reference to the components described above with which they are related. As the exhaust gas E passes from the exhaust manifold 16 and exhaust elbow 18, it enters the inlet 120 of the muffler system and flows through individual sections 301, 302, and 303. The pressure of the exhaust gas causes water level 110 to move downward and also causes water level 112 (not visible in FIG. 7) to move upward in a corresponding manner as described in FIGS. 5 and 6. The exhaust gas E then passes through section 304 and upward through section 305. As the gas continues to flow through section 306 in a direction that is generally back towards the engine 10, it is directed downward again through section 306. At this point, the gas has completed its flow through the first conduit loop of the muffler. The pressure of the gas in section 306 causes water level 320 to move downward. The exhaust gas then passes from section 306 to 307 and horizontally toward the bottom portion of section 308 where it travels upward through the standing water, represented by water level 322. The exhaust then continues its sequential flow through section 309 and then downward through section 310 to the final exhaust conduit, or section 311 to the outlet 124. Between the inlet 120 and the outlet 124 are two complete conduit loops. Each conduit loop provides a water collection region. The first conduit loop comprises sections 303, 304, 305, and 306. The second conduit loop comprises sections 306, 307, 308, and 309. Sections 310 and 311 complete the loop combination to direct the exhaust gas toward the outlet 124. With reference to the terminology used above in conjunction with FIGS. 4–6, the ingress conduit 100 comprises sections 301, 302, and 303. The first water collection cavity 104 comprises section 304 while a second water collection cavity comprises section 307. The egress conduit 108 for the first water collection cavity is section 305 while the egress conduit for the second water collection cavity is section 308.

With reference to FIG. 3, it can be seen that if the water 46 rises within the containment 40 to a level above the opening 68 of the exhausts conduit 20, water can collect within the exhaust conduit 20. Under certain adverse operating conditions, a high level 56 of water 46 within the containment 40 can result in water being drawn back toward the engine 10 through the exhaust conduit 20, resulting in serious damage to the engine 10. This is referred to as "water reversion". As can be seen in FIGS. 4–7, a rise in the water levels within the conduits of the muffler of the present invention will not allow the water to flow back to the exhaust elbow 18 or exhaust manifold 16. In addition, it can be seen that the one or more conduit loops of the present invention can be constructed of simple components, such as elbows and straight sections of channels or conduits. This allows a muffler system to be made much less expensively than traditional water lift mufflers that are known to those skilled in the art. In addition, the present invention provides a confined fluid flow that forces the exhaust to travel sequentially along a predescribed path that is defined by the conduits of the muffler system. Rather than the free flow permitted in water lift mufflers known to those skilled in the art, the exhaust flow of the present invention is a confined fluid flow along this preselected path through the one or more water collection cavities. Therefore, the present invention not only provides a less expensive muffler for a marine propulsion system but, in addition, avoids the potentially deleterious circumstances that can lead to water reversion into the engine.

Although the present invention has been described with particular specificity and illustrated to show several preferred embodiments, it should be understood that alternative embodiments are also within its scope.

I claim:

1. A muffler for an exhaust system of marine propulsion device, comprising:

an ingress conduit which is attachable in fluid communication with an exhaust manifold of an internal combustion engine;

a water collection cavity connected in fluid communication with said ingress conduit;

an egress conduit connected in fluid communication with said water collection cavity, whereby water entrained in an exhaust stream from said engine is induced to accumulate within said water collection cavity, in a lowest region of said ingress conduit, and in a lowest region of said egress conduit in response to said exhaust stream flowing sequentially through said ingress conduit, said water collection cavity, and said egress conduit, said ingress and egress conduits being in fluid communication with each other only indirectly through said water collection cavity, said water collection cavity defining a confined fluid path between said ingress conduit and said egress conduit through which said exhaust stream is restricted by said water collection cavity to travel directly from said ingress conduit to said egress conduit.

2. The muffler of claim 1, wherein:

said water collection cavity is a generally tubular passage between said ingress and egress conduits.

3. The muffler of claim 1, wherein:

said exhaust stream flows sequentially downward through the effective length of said ingress conduit, generally horizontally through the effective length of said water collection cavity, and upward through the effective length of said egress conduit.

4. The muffler of claim 1, further comprising:

a generally horizontal intermediate conduit connected in fluid communication with said egress conduit, with said egress conduit being connected in fluid communication between said water collection cavity and said generally horizontal intermediate conduit.

5. The muffler of claim 4, further comprising:

a final exhaust conduit connected in fluid communication with, and extending downward from, said generally horizontal intermediate conduit.

6. The muffler of claim 1, further comprising:

an internal combustion engine; and an exhaust manifold attached to said engine for directing said exhaust stream from a plurality of cylinders of said internal combustion engine to said ingress conduit, said exhaust manifold being connected in fluid communication with said ingress conduit.

7. An exhaust muffler for a marine propulsion system, comprising:

a first conduit loop which is attachable in fluid communication with an exhaust manifold of an internal combustion engine, said first conduit loop sequentially extending downward through a first section of said first conduit loop from said exhaust manifold and then upward through a second section of said first conduit loop, a central portion of said first conduit loop defining a first water collection region which provides a confined fluid path for an exhaust gas stream between said first and second sections of said first conduit loop through which said exhaust gas stream is restricted by said central portion to travel directly from said first section to said second section, whereby an exhaust stream flows sequentially from said exhaust manifold, downward through said first section of said first conduit loop, through said water collection region directly to said second section, and then upward through said second section of said first conduit loop.

8. The muffler of claim 7, further comprising:

a second conduit loop which is attachable in fluid communication with said first conduit loop, said second conduit loop sequentially extending downward through a third section of said second conduit loop from said first conduit loop and then upward through a fourth section of said second conduit loop, a second central portion of said second conduit loop defining a second water collection region between said first and fourth sections of said first and second conduit loops, whereby an exhaust stream flows sequentially from said exhaust manifold, downward through said first section of said first conduit loop, through said first water collection region, upward through said second section of said first conduit loop, through said third section of said second conduit loop, through said second water collection region, and finally through said fourth section of said second conduit loop.

9. A muffler system for a marine propulsion system, comprising:

a channel for conducting a fluid mixture of exhaust gas and water from an exhaust manifold of an engine, said channel having an inlet, an outlet, and a first transitional section connecting said inlet and said outlet, said first transitional section being positioned below said inlet and said outlet by a sufficient distance to form a first liquid collection region through which said exhaust gas must pass as it flows from said inlet to said outlet, said first transitional section providing a confined path through which said exhaust gas is restricted to flow directly from said inlet to said outlet.

10. The muffler system of claim 9, further comprising:

a second transitional section connecting said inlet and said outlet, said second transitional section being positioned below said inlet and said outlet by a sufficient distance to form a second liquid collection region through which said exhaust gas must pass as it flows from said inlet to said outlet, said first and second transitional sections being connected in serial fluid communication with each other to direct said exhaust gas sequentially from said inlet, through said first liquid collection region, through said second liquid collection region, and through said outlet.

11. The muffler system of claim 10, further comprising:

said exhaust manifold of said engine connected in fluid communication with said inlet.

12. The muffler system of claim 11, further comprising:

an internal combustion engine connected, through said exhaust manifold, in fluid communication with said inlet.

* * * * *